US005421835A

United States Patent [19]

Harding

[11] Patent Number: 5,421,835

[45] Date of Patent: Jun. 6, 1995

[54] SPONTANEOUSLY IGNITABLE FIRE STARTER COMPOSITION

[76] Inventor: Blake W. Harding, 3210 Grace St., Salt Lake City, Utah 84109

[21] Appl. No.: 158,866

[22] Filed: Nov. 29, 1993

[51] Int. Cl.[6] ..... C10L 1/18; C10L 11/04

[52] U.S. Cl. ..... 44/452; 44/628

[58] Field of Search ..... 44/628, 452

[56] References Cited

U.S. PATENT DOCUMENTS 316,327 4/1885 Brown ..... 44/628

OTHER PUBLICATIONS

Bloxam, Chemistry Inorganic & Organic with Experiments, 10th edition p. 463, 1913.

*Primary Examiner*—Jacqueline V. Howard

[57] ABSTRACT

A new and improved fire starter composition includes a liquid fuel component, a solid oxidant component retained in separation from the liquid fuel component until ready for use, and a blend of the liquid fuel component and the solid oxidant component for starting a fire. The liquid fuel component is selected from the group consisting of glycerin, ethyl alcohol, isopropyl alcohol, and methanol, and mixtures thereof. The solid oxidant component is selected from the group consisting of potassium permanganate and potassium dichromate. More specifically, the solid oxidant component is powdered potassium permanganate. In addition, a method is provided for starting a fire, wherein the method includes the steps of: obtaining a quantity of a solid fuel material; adding a quantity of a powdered solid oxidant material to the solid fuel material to obtain a blend of solid fuel material and solid oxidant; adding a quantity of a liquid fuel material to the blend of solid fuel material and solid oxidant; and waiting for a fire to spontaneously burst into flame. In carrying out the method of the invention, the solid oxidant material is selected from the group consisting of potassium permanganate and potassium dichromate; and the liquid fuel material is selected from the group consisting of glycerin, ethyl alcohol, isopropyl alcohol, and methanol, and mixtures thereof.

5 Claims, No Drawings

SPONTANEOUSLY IGNITABLE FIRE STARTER COMPOSITION

BACKGROUND OF THE INVENTION

1. Field of the Invention

The present invention relates to compositions of matter used for starting fires.

2. Description of the Prior Art

The most common method of starting a fire employs using a match. The match includes a quantity of a pyrophoric composition that bursts into flame when undergoing frictional contact with an appropriate surface. A match may be thought of as a highly combustible material; that is, a match is very easily set afire. The match is used to start other materials to become afire. Sometimes these other materials are not very combustible. With such not very combustible materials, a material having an intermediate degree of combustibility is often first ignited by the match. Kindling is an example of a material of intermediate combustibility. The material of intermediate combustibility is used to light the material of low combustibility.

Throughout the years, a number of innovations have been developed relating to compositions that have intermediate combustibility that are ignited by a match and that serve to ignite a material of lower combustibility. The following U.S. Pat. Nos. disclose compositions that are representative of some of these compositions that have intermediate combustibility: 3,726,652; 4,188,192; 4,272,252; 4,485,584; 4,698,068; and 4,878,922. Although the compositions disclosed in the above-mentioned patents may be useful for igniting and setting afire materials of relatively low combustibility, they all depend upon a match or other pyrophoric source for anthill ignition.

For a number of reasons, matches are often not available. They may be forgotten. They may have become mined by being water soaked. In this respect, it would be desirable if a fire-starting composition were provided which were capable of igniting materials of intermediate combustibility and of low combustibility without the need for a match or other pyrophoric material.

Even when matches are readily available, there are certain conditions in which proper ignition of the match is difficult if not impossible. Such conditions mainly include windy conditions. In windy conditions, a match may be struck and ignited and immediately be extinguished by the wind. The match may be extinguished by the wind before it can be used to ignite another combustible material. In this respect, it would be desirable if a fire-starting composition were provided which were capable of burning in windy conditions.

For a fire to bum, a fuel and an oxidizer must be present in proper proportions. Although a wide variety of fuels may be employed, as disclosed in the above-mentioned patents, there is only one oxidizer that is relied upon for combustion—gaseous oxygen in the air. It is well known that of the three states of matter (solid, liquid, and gas), the gaseous state is the least dense. Thus, the most commonly employed oxidizer is present in relatively small concentrations. Liquid oxygen is a much higher density form of oxygen, but liquid oxygen is present only when cryogenic temperatures are obtained. Solid oxygen is even more difficult to obtain. In this respect, it would be desirable if a fire-starting composition were provided which employed a solid form of oxidant to take advantage of the higher density nature of solid materials.

Gaseous oxygen is odorless, tasteless, and invisible. Because gaseous oxygen cannot be perceived by the human senses, it is very possible to overlook or forget its presence and importance. Forgetting the presence or importance of gaseous oxygen can lead to disastrous results if fuels are inadvertently brought up to an ignition temperature. On the other hand, if an oxidant were used that can be seen, such a perceived oxidant could not easily be overlooked or forgotten. In this respect, it would be desirable if a fire-starting composition were provided which included an easily seen oxidant material.

As mentioned above, matches may be wetted or otherwise rendered incapable of performing their igniting function. Yet, upon looking at a match, it may be difficult or impossible to know whether the match will perform properly or not. In this respect, it would be desirable if a fire-starting composition were provided which provided a visible signal as to its capabilities for supporting ignition.

Solid matches are often used to-ignite solid materials. In order for combustion to take place, a solid material must actually be converted into gaseous form. Converting a solid material to gaseous form is one of the functions of raising a solid material to its ignition temperature. There are combustible liquid materials, however, that are much more readily converted into gaseous form than solids. Such liquid materials have a corresponding lower ignition temperature. In this respect, to facilitate the ignition process, it would be desirable if a fire-starting composition of matter were provided which employed a liquid fuel.

Oxidants have been classified on a scale of oxidizing power and are tabulated in a table of oxidation potentials. Although gaseous oxygen is a powerful oxidant, there are two readily available solid oxidants that have respective greater oxidation potentials than gaseous oxygen. Both dichromates and permanganates are stronger oxidants than gaseous oxygen. Thus, the readily available solid potassium dichromate and the readily available solid potassium permanganate are stronger oxidizing agents than gaseous oxygen. In this respect, it would be desirable if a fire-starting composition were provided which employed a solid oxidant that has greater oxidizing power than gaseous oxygen.

Because a fire-starting composition containing a fuel and oxidant is so readily susceptible to combustion, it would be desirable if a fire-starting composition had its fuel separated from its oxidant until the fire-starting composition is ready for use.

As stated above, a fuel must be brought to an ignition temperature in order for a fire to start. In relatively hot weather, the fuel may be relatively close to its ignition temperature. However, in relatively cold weather, the fuel may be relatively far from its ignition temperature. As a result, starting a fire in cold weather may be a difficult if not impossible task. This is especially troublesome for starting a camp fire where the camp fire may be necessary to prevent harmful exposure to the cold. In this respect, it would be desirable if a fire-starting composition were provided which were readily ignitable in cold weather.

There is a well known phenomenon known as spontaneous combustion. Spontaneous combustion may occur when a unique set of conditions converge which include fuel, oxidant, and ignition temperature. Spontaneous combustion is most often thought of as a dangerous condition that is to be prevented and avoided. However, it would be desirable if the principles underlying spontaneous combustion could be controlled so that a fire-starting composition could undergo spontaneous combustion when desired.

Thus, while the foregoing body of prior art indicates it to be well known to use fire-starting compositions, the prior art described above does not teach or suggest a fire starter composition which has the following combination of desirable features: (1) is capable of igniting materials of intermediate combustibility and of low combustibility without the need for a match or other pyrophoric material; (2) is capable of burning in windy conditions; (3) employs a solid form of oxidant to take advantage of the higher density nature of solid materials; (4) includes an easily seen oxidant material; (5) provides a visible signal as to its capabilities for supporting ignition; (6) employs a solid oxidant that has greater oxidizing power than gaseous oxygen; (7) has its fuel separated from its oxidant until the firestarting composition is ready for use; (8) is readily ignitable in cold weather; and (9) can undergo spontaneous combustion when desired. The foregoing desired characteristics are provided by the unique spontaneously ignitable fire starter composition of the present invention as will be made apparent from the following description thereof. Other advantages of the present invention over the prior art also will be rendered evident.

SUMMARY OF THE INVENTION

To achieve the foregoing and other advantages, the present invention, briefly described, provides a new and improved fire starter composition which includes a liquid fuel component, a solid oxidant component retained in separation from the liquid fuel component until ready for use, and a blend of the liquid fuel component and the solid oxidant component for starting a fire.

The liquid fuel component is selected from the group consisting of glycerin, ethyl alcohol, isopropyl alcohol, and methanol, and mixtures thereof. More specifically, the liquid fuel component includes glycerin, in a range of 35–65% by weight, isopropyl alcohol, in a range of 31–51% by weight, and methanol, in a range of 4–13% by weight. Even more specifically, the liquid fuel component includes glycerin, 50% by weight, isopropyl alcohol, 41% by weight, and methanol, 9% by weight.

The solid oxidant component is selected from the group consisting of potassium permanganate and potassium dichromate. More specifically, the solid oxidant component is powdered potassium permanganate.

In accordance with another aspect of the present invention, a method is provided for starting a fire, wherein the method includes the steps of: obtaining a quantity of a solid fuel material; adding a quantity of a powdered solid oxidant material to the solid fuel material to obtain a blend of solid fuel material and solid oxidant; adding a quantity of a liquid fuel material to the blend of solid fuel material and solid oxidant; and waiting for a fire to spontaneously burst into flame.

In carrying out the method of the invention, the solid oxidant material is selected from the group consisting of potassium permanganate and potassium dichromate. Also, in carrying out the method of the invention, the liquid fuel material is selected from the group consisting of glycerin, ethyl alcohol, isopropyl alcohol, and methanol, and mixtures thereof.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining a preferred embodiment of the invention in detail, it is understood that the invention is not limited in its application to the details of the components set forth in the following description. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

Further, the purpose of the foregoing Abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

It is therefore an object of the present invention to provide a new and improved spontaneously ignitable fire starter composition which has all of the advantages of the prior art and none of the disadvantages.

It is another object of the present invention to provide a new and improved spontaneously ignitable fire starter composition which may be easily and efficiently manufactured and marketed.

An even further object of the present invention is to provide a new and improved spontaneously ignitable fire starter composition which is susceptible of a low cost of manufacture with regard to both materials and labor, and which accordingly is then susceptible of low prices of sale to the consuming public, thereby making such spontaneously ignitable fire starter composition available to the buying public.

Still yet a further object of the present invention is to provide a new and improved spontaneously ignitable fire starter composition which is capable of igniting materials of intermediate combustibility and of low combustibility without the need for a match or other pyrophoric material.

Still another object of the present invention is to provide a new and improved spontaneously ignitable fire starter composition that is capable of burning in windy conditions.

Yet another object of the present invention is to provide a new and improved spontaneously ignitable fire starter composition which employs a solid form of oxidant to take advantage of the higher density nature of solid materials.

Even another object of the present invention is to provide a new and improved spontaneously ignitable fire starter composition that includes an easily seen oxidant material.

Still a further object of the present invention is to provide a new and improved spontaneously ignitable fire starter composition which provides a visible signal as to its capabilities for supporting ignition.

Yet another object of the present invention is to provide a new and improved spontaneously ignitable fire starter composition that employs a solid oxidant that has greater oxidizing power than gaseous oxygen.

Still another object of the present invention is to provide a new and improved spontaneously ignitable fire starter composition which has its fuel separated from its oxidant until the fire-starting composition is ready for use.

Yet another object of the present invention is to provide a new and improved spontaneously ignitable fire starter composition that is readily ignitable in cold weather.

Still a further object of the present invention is to provide a new and improved spontaneously ignitable fire starter composition that can undergo spontaneous combustion when desired.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying descriptive matter in which there are disclosed preferred embodiments of the invention.

DESCRIPTION OF THE PREFERRED EMBODIMENT

A spontaneously ignitable fire starter composition embodying the principles and concepts of the present invention will be described. The spontaneously ignitable fire starter composition of the invention includes a liquid fuel component, a solid oxidant component retained in separation from the liquid fuel component until ready for use, and a blend of the liquid fuel component and the solid oxidant component for starting a fire.

The liquid fuel component is selected from the group consisting of glycerin, ethyl alcohol, isopropyl alcohol, and methanol, and mixtures thereof. More specifically, the liquid fuel component includes glycerin, in a range of 35–65% by weight, isopropyl alcohol, in a range of 31–51% by weight, and methanol, in a range of 4–13% by weight. Even more specifically, the liquid fuel component includes glycerin, 50% by weight, isopropyl alcohol, 41% by weight, and methanol, 9% by weight.

The solid oxidant component is selected from the group consisting of potassium permanganate and potassium dichromate. More specifically, the solid oxidant component is powdered potassium permanganate.

EXAMPLE 1

The liquid fuel component includes glycerin, 50% by weight, isopropyl alcohol, 41% by weight, and methanol, 9% by weight. The liquid fuel component is stored in a first storage container which can be a 1 ounce bottle. The solid oxidant component includes powdered potassium permanganate. The powdered potassium permanganate is stored in a second storage container which can be a 1 ounce bottle.

In use, a capful of the powdered potassium permanganate in Example 1 is removed from the second storage container and placed on dry, burnable, solid fuel material such as paper, twigs, grass, kindling, etc. to form a blend of solid fuel and solid oxidant. Then, 20 drops of the liquid fuel component in Example 1 are dispensed from the first storage container onto the blend of the solid fuel and solid oxidant. After a wait of from 20–60 seconds, the materials spontaneously burst into flame. It is clear that, by using the invention, a fire can be started without the use of a match.

The quantity of the liquid fuel material in the first storage container (capacity of 1 ounce) and the quantity of the solid oxidant in the second storage container (capacity of 1 ounce) are sufficient for starting approximately 20 camp fires.

In accordance with another aspect of the present invention, a method is provided for starting a fire, wherein the method includes the steps of: obtaining a quantity of a solid fuel material; adding a quantity of a powdered solid oxidant material to the solid fuel material to obtain a blend of solid fuel material and solid oxidant; adding a quantity of a liquid fuel material to the blend of solid fuel material and solid oxidant; and waiting for a fire to spontaneously burst into flame.

In carrying out the method of the invention, the solid oxidant material is selected from the group consisting of potassium permanganate and potassium dichromate. Also, in carrying out the method of the invention, the liquid fuel material is selected from the group consisting of glycerin, ethyl alcohol, isopropyl alcohol, and methanol, and mixtures thereof.

The components of the spontaneously ignitable fire starter composition of the invention are readily available and inexpensive materials.

As to the manner of usage and operation of the instant invention, the same is apparent from the above disclosure, and accordingly, no further discussion relative to the manner of usage and operation need be provided.

It is apparent from the above that the present invention accomplishes all of the objects set forth by providing a new and improved spontaneously ignitable fire starter composition that is low in cost, relatively simple in design and operation, and which may advantageously be used to ignite materials of intermediate combustibility and of low combustibility without the need for a match or other pyrophoric material. With the invention, a spontaneously ignitable fire starter composition is provided which is capable of burning in windy conditions. With the invention, a spontaneously ignitable fire starter composition is provided which employs a solid form of oxidant to take advantage of the higher density nature of solid materials. With the invention, a spontaneously ignitable fire starter composition is provided which includes an easily seen oxidant material. With the invention, a spontaneously ignitable fire starter composition is provided which provides a visible signal as to its capabilities for supporting ignition. With the invention, a spontaneously ignitable fire starter composition is provided which employs a solid oxidant that has greater oxidizing power than gaseous oxygen. With the invention, a spontaneously ignitable fire starter composition is provided which has its fuel separated from its oxidant until the fire-starting composition is ready for use. With the invention, a spontaneously ignitable fire starter composition is provided which is readily ignitable in cold weather. With the invention, a spontaneously ignitable fire starter composition is provided which can undergo spontaneous combustion when desired.

With respect to the above description, it should be realized that the optimum relationships for the component parts of the invention include variations in proportions and ingredients that are deemed readily apparent and obvious to those skilled in the art, and therefore, all relationships equivalent to those described in the specification are intended to be encompassed only by the scope of appended claims.

While the present invention has been fully described above with particularity and detail in connection with what is presently deemed to be the most practical and preferred embodiments of the invention, it will be apparent to those of ordinary skill in the art that many modifications thereof may be made without departing from the principles and concepts set forth herein. Hence, the proper scope of the present invention should be determined only by the broadest interpretation of the appended claims so as to encompass all such modifications and equivalents.

What is claimed as being new and desired to be protected by Letters Patent of the United States is as follows:

1. A new and improved fire starter composition, consisting essentially of:

a blend of an organic liquid fuel component and a solid oxidant component for starting a fire, wherein said liquid fuel component includes glycerin in a range of 35–65% by weight, isopropyl alcohol in a range of 31–51% by weight, and methanol in a range of 4–13% by weight, and wherein said solid oxidant component, which is retained in separation from the liquid fuel component until ready for use, is selected from the group consisting of potassium permanganate and potassium dichromate.

2. The composition described in claim 1 wherein said liquid fuel component includes: glycerin, 50% by weight; isopropyl alcohol, 41% by weight; and methanol, 9% by weight.

3. The composition described in claim 1 wherein said solid oxidant component is powdered potassium permanganate.

4. A method of starting a fire, comprising the steps of:

first, obtaining a quantity of a solid fuel material, second, adding a quantity of a powdered solid oxidant material selected from the group consisting of potassium permanganate and potassium dichromate to the solid fuel material to obtain a blend of solid fuel material and solid oxidant, third, adding a quantity of an organic liquid fuel material selected from the group consisting of glycerin, ethyl alcohol, isopropyl alcohol, and methanol, and mixtures thereof to the blend of solid fuel material and solid oxidant, and fourth, waiting for a fire to spontaneously burst into flame.

5. The method described in claim 4 wherein the organic liquid fuel material includes: glycerin, 50% by weight; isopropyl alcohol, 41% by weight; and methanol, 9% by weight.

* * * * *